US007025503B2

(12) United States Patent
Plourde

(10) Patent No.: US 7,025,503 B2
(45) Date of Patent: Apr. 11, 2006

(54) RECLOSABLE PACKAGING HAVING ZIPPER WITH RECESSED SLIDER END STOPS

(75) Inventor: Eric Paul Plourde, Homewood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/261,476

(22) Filed: Sep. 30, 2002

(65) Prior Publication Data

US 2004/0062457 A1 Apr. 1, 2004

(51) Int. Cl.
*B65D 33/16* (2006.01)

(52) U.S. Cl. ..... 383/64; 24/399; 24/387

(58) Field of Classification Search ..... 383/64; 24/399–400, 387

See application file for complete search history.

(56) References Cited

U.S. PATENT DOCUMENTS 5,067,208 A 11/1991 Herrington et al.
5,088,971 A 2/1992 Herrington
5,131,121 A 7/1992 Herrington et al.
5,161,286 A 11/1992 Herrington et al.
5,442,837 A 8/1995 Morgan
5,448,807 A 9/1995 Herrington
5,871,281 A * 2/1999 Stolmeier et al. ..... 383/64
5,950,285 A 9/1999 Porchia et al.
6,698,926 B1 * 3/2004 Buchman ..... 383/64
6,846,108 B1 * 1/2005 Buchman ..... 383/64
6,854,887 B1 * 2/2005 Anderson ..... 383/64
6,895,641 B1 * 5/2005 Savicki ..... 24/387
6,896,409 B1 * 5/2005 Plourde et al. ..... 383/64

* cited by examiner

*Primary Examiner*—Jes F. Pascua
(74) *Attorney, Agent, or Firm*—Ostrager Chong Flaherty & Broitman P.C

(57) ABSTRACT

A slider-operated zipper having recessed slider end stops. The recesses can be formed in top portions of the profiled closure members or in outwardly facing side portions of one or both profiled closure members. Alternatively, the openings of throughholes that pass through the profiled closure members can serve as end stop recesses. The slider has one or more projections or ridges designed to impinge on a wall of a respective recess or throughhole opening in the zipper, thereby stopping the slider, provided that the pull off resistance is not overcome.

17 Claims, 8 Drawing Sheets

RECLOSABLE PACKAGING HAVING ZIPPER WITH RECESSED SLIDER END STOPS

BACKGROUND OF THE INVENTION

This invention generally relates to slider-operated zippers for use in reclosable packaging, such as bags or pouches. In particular, the invention relates to zippers having slider end stops.

Reclosable bags are finding ever-growing acceptance as primary packaging, particularly as packaging for foodstuffs such as cereal, fresh vegetables, snacks and the like. Such bags provide the consumer with the ability to readily store in a closed, if not sealed, package any unused portion of the packaged product even after the package is initially opened. To gain acceptance as a primary package for foodstuffs, it is virtually mandatory that the package exhibit some form of tamper evidence to protect the consumer and maintain the wholesomeness of the contained product. In addition, in many cases it is necessary that food product be hermetically packaged.

Reclosable fastener assemblies are useful for sealing thermoplastic pouches or bags. Such fastener assemblies typically include a plastic zipper and a plastic slider. Typically, the plastic zippers include a pair of interlockable profiled members that form a closure. As the slider moves across the profiles, the profiles are opened or closed. The profiles in plastic zippers can take on various configurations, e.g. interlocking rib and groove elements having so-called male and female profiles, interlocking alternating hook-shaped closure members, etc. Reclosable bags having slider-operated zippers are generally more desirable to consumers than bags having zippers without sliders because the slider eliminates the need for the consumer to align the interlockable zipper profiles before causing those profiles to engage.

In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Other types of slider-operated zipper assemblies avoid the use of a separating finger. For example, U.S. Pat. No. 6,047,450 discloses a zipper comprising a pair of mutually interlockable profiled closure members, portions of which form a fulcrum about which the profiled closure members may be pivoted out of engagement when lower edges of the bases are forced towards each other.

One of the important features of such reclosable fastener assemblies are the end stops, which prevent the slider from falling off the end of the fastener. End stops have taken on various configurations, such as, for example, riveted end clamps such as those described in U.S. Pat. Nos. 5,067,208 and 5,161,286; transverse end stops made from molten material of the fastener strips, as described in U.S. Pat. No. 5,088,971; reciprocating anvils, as described in U.S. Pat. No. 5,131,121; tubular end stops, as described in U.S. Pat. No. 5,405,478; a window structure (i.e., a recess) combined with sealed zipper ends, as described in U.S. Pat. No. 5,442,837; or plastic end clips fused to the zipper as described in U.S. Pat. No. 5,448,807. In U.S. Pat. No. 5,442,837, the recesses in the zipper flanges form a window for receiving a horizontal portion of a separator structure that depends from the top wall of the slider.

U.S. Pat. No. 5,950,285 discloses a reclosable bag having end stops that prevent a slider from moving beyond the end of the zipper when the slider reaches either the closed or fully open position. The end stops are formed from the material of the zipper profiles and "rise vertically" from the zipper to block and prevent further longitudinal movement of the slider. The end stops are formed by first aligning together the opposing profiles at an end stop area proximate to an end of the bag, and then fusing the zipper profiles at the end stop area to provide a vertical structure for preventing movement of the slider past the ends of the zipper, while at the same time keeping the so-called "rails," i.e., the corners of the zipper profile that retain the slider, intact.

A vertical end stop may fold or bend when a slider is pressed against the end stop. If the end stop folds or bends, the slider may not be stopped, thereby rendering the end stop ineffective. There is a need for alternative slider end stop designs.

BRIEF DESCRIPTION OF THE INVENTION

The invention is directed in part to a slider-operated zipper having recessed slider end stops. The recesses can be formed in top portions of the profiled closure members or in outwardly facing side portions of one or both profiled closure members. Alternatively, the openings of through-holes that pass through the profiled closure members can serve as end stop recesses. The invention is also directed to a slider having one or more projections or ridges designed to impinge on a wall of a respective recess or throughhole opening in the zipper, thereby stopping the slider, provided that the pull off resistance is not overcome.

One aspect of the invention is a slider-zipper assembly comprising a zipper and a slider mounted to the zipper, wherein the zipper comprises first and second interlockable profiled closure members joined along respective sections proximal to respective ends of the zipper, and a recess proximal to one end of the zipper and defined in part by a stopping surface generally facing toward the other end of the zipper. The slider is movable between first and second slider park positions for engaging or disengaging confronting portions of the first and second closure members and comprises a projection arranged to impinge on the stopping surface. The stopping surface poses an obstacle to further travel of the slider in one direction during impingement of the projection on the stopping surface. The projection is disposed outside the zipper when the slider is located in the middle of the zipper.

Another aspect of the invention is a slider-zipper assembly comprising a zipper and a slider mounted to the zipper, wherein the zipper comprises first and second interlockable profiled closure members joined along respective sections proximal to respective ends of the zipper, a first recess proximal to one end of the zipper and defined in part by a first stopping surface generally facing toward the other end of the zipper, and a second recess proximal to the other end of the zipper and defined in part by a second stopping surface generally facing toward the one end of the zipper. The slider is movable between first and second slider park positions for engaging or disengaging confronting portions of the first and second closure members, a first portion of the slider being in contact with the first stopping surface in the first slider park position and a second portion of the slider being in contact with the second stopping surface in the second slider park position. The first and second portions of the slider are disposed outside the zipper when the slider is located in the middle of the zipper.

A further aspect of the invention is a slider-zipper assembly comprising a zipper and a slider mounted to the zipper, wherein the zipper comprises first and second interlockable profiled closure members joined along respective sections proximal to respective ends of the zipper, a first throughhole proximal to one end of the zipper and a second throughhole proximal to the other end of the zipper. Each of the first and second throughholes passes through the first and second profiled closure members. The slider is movable between first and second slider park positions for engaging or disengaging confronting portions of the first and second closure members, a first portion of the slider being inserted in one end of the first throughhole in the first slider park position and a second portion of the slider being inserted in one end of the second throughhole in the second slider park position.

Another aspect of the invention is a reclosable package comprising: a receptacle having a mouth; and a slider-zipper assembly joined to the receptacle in a manner such that the mouth is closed when the profiled closure members are interlocked with each other and the mouth is open when the profiled closure members are disengaged from each other, the slider-zipper assembly being as described in any of the preceding three paragraphs.

Yet another aspect of the invention is a slider for opening and closing a plastic zipper, comprising: first and second sidewalls; a first cantilevered arm having one end connected to the first side wall and extending forward of the first side wall; a second cantilevered arm having one end connected to the second side wall and extending forward of the second side wall; a third cantilevered arm having one end connected to the first side wall and extending rearward of the first side wall; and a fourth cantilevered arm having one end connected to the second side wall and extending rearward of the second side wall. The first and second cantilevered arms are opposed to each other and can be flexed toward and away from each other. Likewise the third and fourth cantilevered arms are opposed to each other and can be flexed toward and away from each other.

Another aspect of the invention is a slider for opening and closing a plastic zipper, comprising: an opening end comprising a top portion, first and second side portions respectively connected to opposing ends of the top portion of the opening end; a closing end comprising a top portion, and first and second side portions respectively connected to opposing ends of the top portion of the closing end, the closing end being separated from the opening end by a central zone; and a ridge integrally connected to the one of the first and second side portions of one of the opening and closing ends and projecting inward. The ridge comprises an end face and a tapered body having a dimension that decreases as the distance from the end face increases. The tapered body extends from the end face toward the other of the opening and closing ends.

Another aspect of the invention is a slider for opening and closing a plastic zipper, comprising: an opening end comprising a top portion, first and second side portions respectively connected to opposing ends of the top portion of the opening end; a closing end comprising a top portion, and first and second side portions respectively connected to opposing ends of the top portion of the closing end, the closing end being separated from the opening end by a central zone; and first and second ridges respectively integrally connected to the first and second side portions of the opening end and projecting toward each other; and third and fourth ridges respectively integrally connected to the first and second side portions of the closing end and projecting toward each other. The first ridge comprises a first end face and a first tapered body having a dimension that decreases as the distance from the first end face increases, and the second ridge comprises a second end face and a second tapered body having a dimension that decreases as the distance from the second end face increases, the first and second tapered bodies extending from the first and second end faces respectively toward the closing end. The third ridge comprises a third end face and a third tapered body having a dimension that decreases as the distance from the third end face increases, and the fourth ridge comprises a fourth end face and a fourth tapered body having a dimension that decreases as the distance from the fourth end face increases, the third and fourth tapered bodies extending from the third and fourth end faces respectively toward the opening end.

Other aspects of the invention are disclosed and claimed below.

BRIEF DESCRIPTION OF THE DRAWINGS

In FIG. 3 the zipper is closed, while in FIG. 4 the zipper is open.

In FIG. 9 the zipper is closed, while in FIG. 10 the zipper is open.

DETAILED DESCRIPTION OF THE INVENTION

The first embodiment of the invention, a reclosable bag comprising a slider-zipper assembly of the fulcrum type, will be described with reference to FIGS. 1–4. The assembly comprises a plastic zipper 10 and a plastic slider 12 mounted to the zipper 10. The zipper 10 comprises first and second interlockable profiled closure members 2 and 4 joined along respective sections proximal to respective ends of the zipper. In the illustrated case, the closure members 2 and 4 are joined along end sections of the zipper, only one of which is shown in each of FIGS. 1 and 2.

Figure 3:
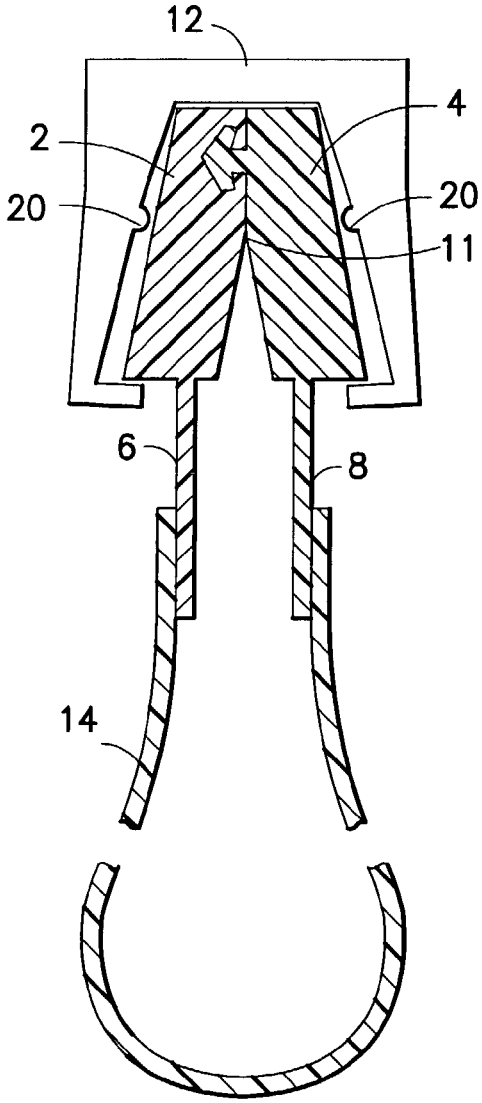
FIGS. 3 and 4 are drawings showing sectional views of the portion of reclosable package depicted in FIG. 1, the sections being respectively taken along lines 3—3 and 4—4 indicated in FIG. 1.
Figure 4:
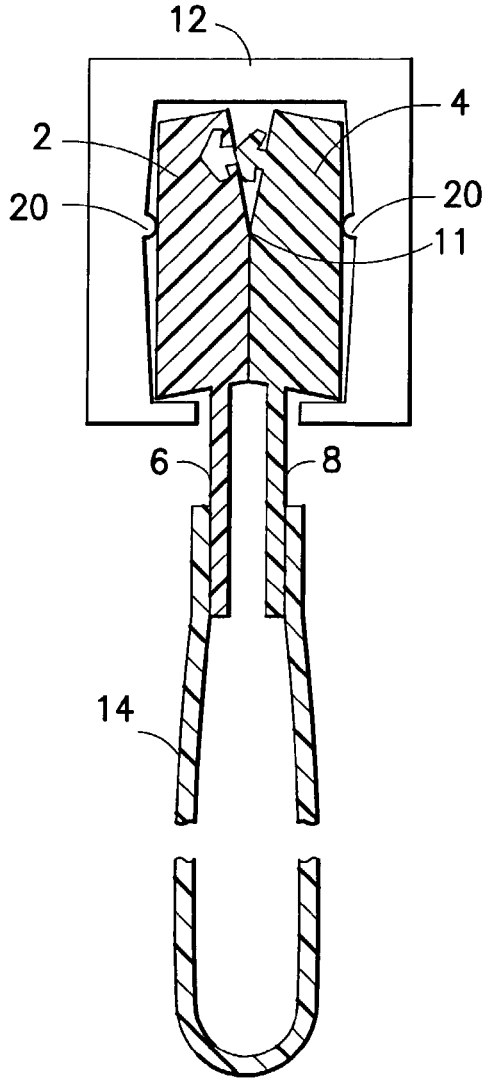

As best seen in FIGS. 3 and 4, a web of bag making film 14 may be folded at the bottom to form a front wall and a rear wall. Although not shown in FIGS. 3 and 4, the front and rear walls are also joined at the sides of the package, at least from the bottom to the slider end stops on the zipper, by respective side seals. The bag making film may be a laminate or coextrusion comprising a gas barrier layer and/or a low-melting-point sealant layer.

The zipper 10 comprises a closure member 2 having a female profile and a closure member 4 having a male profile that interlocks with the female profile in the zipper section being closed as the slider travels in the closing direction. The zipper 10 further comprises a zipper flange 6 having one end connected or joined to closure member 2 and a zipper flange 8 having one end connected or joined to closure member 4.

The zipper flange 6 is typically secured to one bag wall by a permanent seal proximal to the top of the bag, while zipper flange 8 is secured to the other bag wall by a permanent seal. It should be appreciated that each permanent seal is a band of joined, e.g., fused, material that extends from one side seal of the bag to the other side seal, thereby securing the zipper to the bag along the width of the bag. These permanent seals are generally parallel to each other and may be formed by any conventional method, such as conduction heat sealing.

FIGS. 3 and 4 illustrate a dual flange zipper. Alternatively, the zipper flanges could be connected at their distal ends to form a cusp, with a line of reduced tear resistance running along the cusp. In accordance with a further alternative, a split-flange zipper could be manufactured by extruding the zipper profiles onto a continuous membrane, which membrane is later cut on one side to form the split flanges, one being longer than the other. The short flange would be sealed to one bag wall, while the long flange would be sealed to both walls of the receptacle. The long flange is folded to form a cusp having a line of reduced tear resistance therein. In a further alternative, the zipper profiles and the bag making film could be extruded as one piece.

As illustrated in FIGS. 3 and 4, the zipper 10 and slider 12 form a slider-zipper assembly of the fulcrum type. The outer surfaces of the closure members are not parallel, but diverge downwardly to form a shape that resembles the letter "A". Because of this "A" configuration, the zipper is difficult to open from the contents (i.e., product) side of the receptacle since the opening force tends to push the lower extremities of the profiled closure members apart, thereby enhancing the interlock between the male member and the female member. The closure members 2 and 4 have opposing portions that form a fulcrum 11. Although FIGS. 3 and 4 show the fulcrum 11 as being at the contact point of opposing convex portions, the fulcrum may alternatively be formed by a concave portion on one closure member contacting a convex portion on the other closure member. The details of such a structure can be found in U.S. Pat. No. 6,047,450.

When the distal edges of the closure members 2 and 4 are forced towards each other by the side walls of the slider 12, the resulting leverage causes the closure members to pivot oppositely about the fulcrum 11 and disengage from each other, as shown in FIG. 4. The male member is shaped to readily permit easy disengagement from the female member.

The slider 12 can be top-loaded onto the zipper 10 without having to disengage the profiled closure members at the loading point since the slider does not make use of a separating finger. The slider is slidable along the zipper in either a closing direction or an opening direction opposite to the closing direction. The profiled closure members 2 and 4 are fully engaged, i.e., interlocked, with each other as the slider travels in the closing direction. The profiled closure members 2 and 4 are disengaged from each other as the slider travels in the opening direction. The slider 12 is preferably made of a resilient plastic material, such as delrin, polypropylene, PBT, etc.

FIG. 3 depicts a closing end of the slider, while FIG. 4 depicts an opening end of the slider. The closing end is shaped to force the profiled closure members 2 and 4 into engagement when the slider 12 travels in the closing direction. The closing end is so-called because it is the end where the zipper profiled closure members 2, 4 are forced into engagement when the slider 12 is moved in the closing direction. During slider travel in the closing direction, the closing end is the trailing end of the slider. Similarly, during slider travel in the opening direction, the opening end of the slider is trailing.

Figure 2:
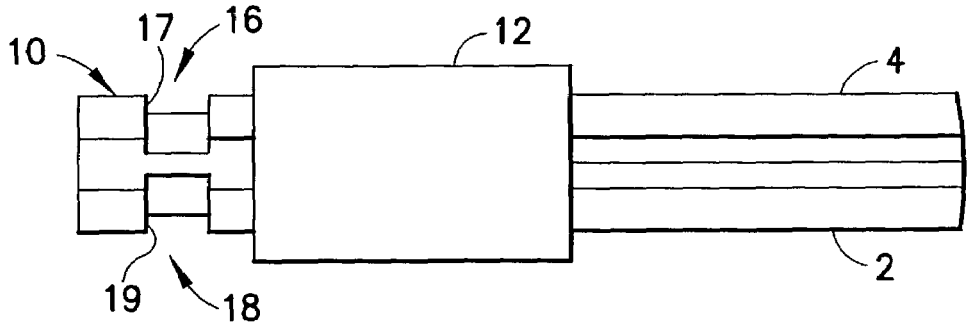
FIG. 2 is a drawing showing a top view of the portion of reclosable package depicted in FIG. 1.

As shown in FIG. 2, the slider 12 straddles the zipper 10 and has a top wall from which a pair of arms or sidewalls depend. However, a top wall running the full length of the slider is not necessary. As an alternative construction, for example, the sidewalls could be connected to respective ends of a pair of top beams that are parallel to each other. One top beam and adjoining portions of the sidewalls would be configured to act as an opening window, while the other top beam and adjoining portions of the sidewalls would be configured to act as a closing window. The slider arms or sidewalls are respectively provided with retaining shoulders having upper surfaces that mate with lower surfaces of the profiled closure members 2 and 4. These surfaces may be tapered to maximize their pull-off resistance. The mating of these surfaces, in combination with the "A" configuration of the profiled members 2, 4, prevents the slider 12 from being inadvertently pulled off the zipper 10 during use, since an upward pulling motion will tend to pull the profile bases apart at their distal ends, thereby locking the slider 12 onto the zipper 10.

In accordance with the embodiment of the invention shown in FIGS. 1–4, each end section of the zipper 10 has a pair of recesses 16 and 18, only one such end section being shown in FIG. 2. In the disclosed embodiment, each recess is a channel of rectangular cross section. In another embodiment, the recess can be ramp shaped, sloping from the surface of the zipper down to the base of the stopping surface. However, in its broadest scope the invention is not limited to the particular geometries of the embodiments disclosed herein. The recesses 16 and 18 can be formed by cutting, ultrasonic stomping, molding or any other method for deforming thermoplastic material. Although this embodiment has recesses on both sides of the zipper on both ends, the invention also encompasses zippers in which each end section has only one recess, for example, a recess formed on only one of the two sides of the zipper. As will be disclosed below, the single recess at each end can, in the alternative, be formed in the top of the zipper.

Any geometry can be utilized so long as each recess has a slider stopping surface, against which some portion of the slider can impinge. Each stopping surface generally faces toward the other end of the zipper. The stopping surfaces for recesses 16 and 18, shown in FIG. 2, are respectively designated by numerals 17 and 19. The stopping surfaces 17 and 19 are preferably substantially perpendicular to the longitudinal axis of the zipper, or are disposed oblique to the zipper longitudinal axis, forming an acute angle with the planar base of the recess.

The stopping surfaces 17 and 19 of recesses 16 and 18 form a slider end stop at one end of the zipper, stopping the slider at a first park position. It should be appreciated that the other end of the zipper will be similarly constructed to stop the slider at a second park position. Thus the slider is movable only along the path between the first and second park positions located at opposite ends of the zipper. In one slider park position, the zipper is fully open; in the other slider park position, the zipper is fully closed.

The stopping surfaces work in conjunction with contacting surfaces of projections or ridges formed on the slider. The slider has one projection or ridge for each stopping surface formed in the zipper. In the embodiment depicted in FIGS. 1–4, the zipper has four recesses, each recess having a stopping surface, and the slider has four ridges 20, two being visible in FIG. 3 and the other two being visible in FIG. 4. Each ridge 20 has a tapered convex surface, with the wide end of the ridge being proximal to an end of the slider and the ridge tapering inward toward the center of the slider The axis of the ridge is substantially parallel to the direction of slider movement.

Figure 5:
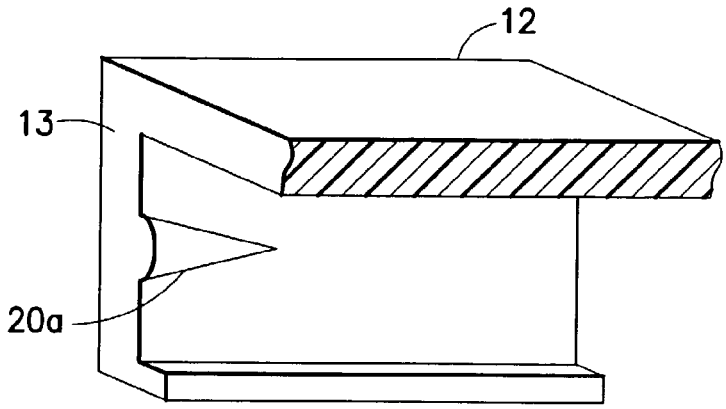
FIG. 5 is a drawing showing a fragmentary isometric view of the slider depicted in FIGS. 1–4.
Figure 6:
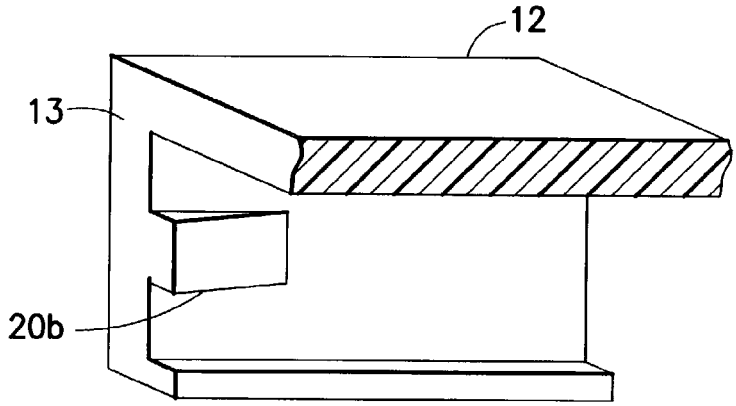
FIGS. 6 and 7 are drawings showing fragmentary isometric views of respective sliders in accordance with alternative embodiments of the invention.
Figure 7:
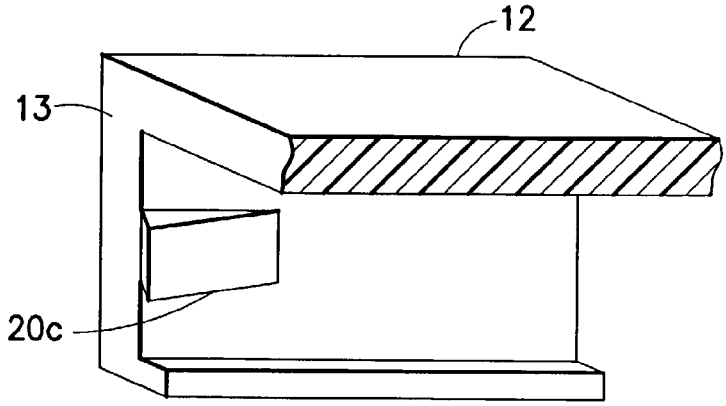

Three exemplary ridges with different geometries are shown in FIGS. 5–7. FIG. 5 shows part of a slider with a ridge 20*a* that has a conical surface and a planar end face. The planar end face of ridge 20*a* is coplanar with an adjacent end face 13 of the slider 12, the latter in turn being generally perpendicular to the longitudinal axis of the zipper. Alternatively, the ridge could have a tapered convex surface of curving form that is not conical. FIG. 6 shows part of a slider with a ridge 20*b* that has a ramp shape and a planar end face. Again the planar end face is coplanar with the end face 13 of the slider. FIG. 7 shows part of a slider with a ridge 20*c* that also has a ramp shape and a planar end face. In this example, however, the planar end face—rather than being coplanar with the end face 13 of the slider—is angled forward of the end face of the slider, forming an obtuse angle with slider end face 13.

Figure 1:
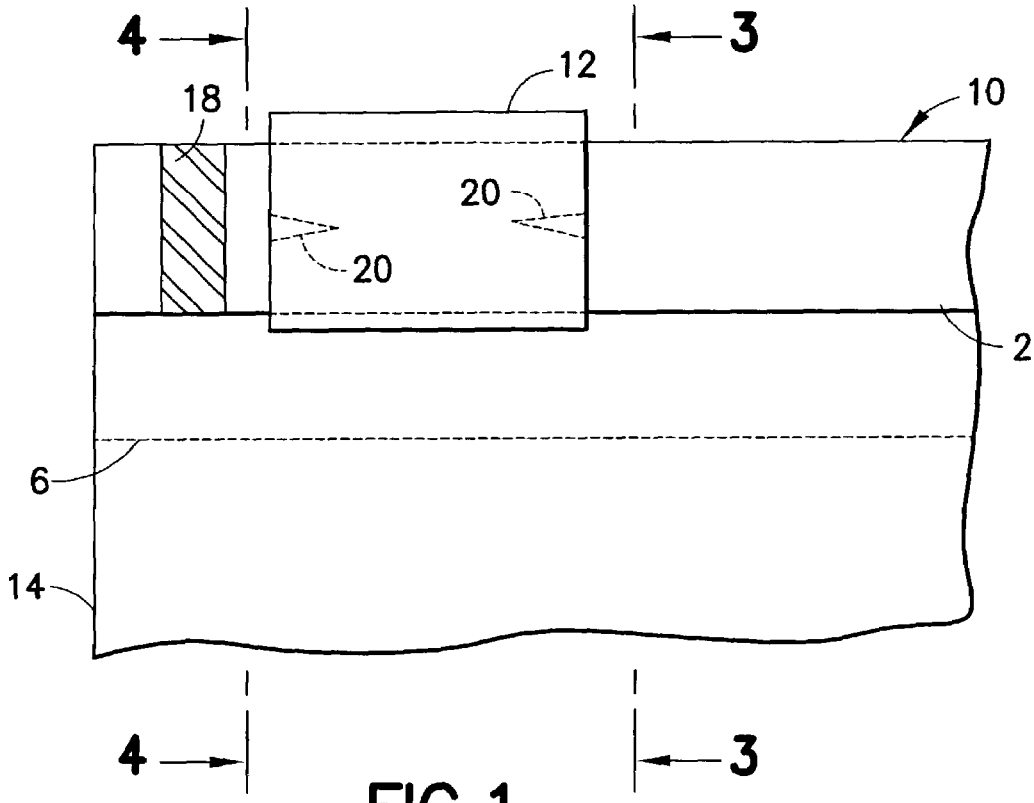
FIG. 1 is a drawing showing a fragmentary front elevational view of a reclosable package incorporating a slider-zipper assembly in accordance with one embodiment of the invention.

As seen in FIGS. 3 and 4, the ridges 20 at both ends of the slider 12 are located at the same level or elevation as the fulcrum 11 of the zipper. At the level of the fulcrum, the width of the zipper remains substantially the same whether the zipper is opened or closed. Referring now to FIG. 1, the slider can be moved leftward from the position shown until the slider reaches a position where the end face of the ridge 20 impinges on the stopping surface 19 of recess 18. At the same time, the end face of the ridge on the other side of the slider (not visible in FIG. 2) impinges on the stopping surface 17 of recess 16 on the other side of the zipper. Thus the stopping surfaces 17 and 19 pose an obstacle to further leftward travel of the slider, thereby stopping the slider from being pulled off the end of the zipper, provided that the pull-off force is not exceeded. The same action occurs when the slider is moved to the opposite end of the zipper (not shown in FIG. 1). In the case where the stopping surfaces 17 and 19 are generally perpendicular to the longitudinal axis of the zipper, the planar end faces of the impinging ridges are also preferably generally perpendicular to the longitudinal axis of the zipper. Therefore, when the end faces of the ridges impinge on the stopping surfaces, the contacting surfaces are generally parallel to each other. Similarly, if the stopping surfaces 17 and 19 are disposed at an acute angle relative to the planar bases of the recesses 16 and 18 respectively, then the end faces of the corresponding ridges 20 on the slider 12 should be disposed at a supplementary oblique angle relative to the slider end face 13 (see FIG. 7).

In cases where the ridges or projections that cooperate in stopping the slider are supported by the slider sidewalls, the latter are designed with a degree of elasticity. The elasticity of the slider sidewalls must be sufficient to allow the ridges or projections to ride along the external surface of the zipper when the slider is disposed in the middle of the zipper, and then flex inward when the ridge or projection ceases to bear against the zipper profile and overlies a recess formed with a stopping surface in the zipper. Thus, the portions of the slider sidewalls that carry the opposing ridges or projections should be elastically flexible toward and away from each other, i.e., in a lateral direction perpendicular to the longitudinal axis of the zipper. In an ideal design, the overall profile of the zipper is substantially constant along its length except where the recesses with stopping surfaces are formed, e.g., by cutting. Thus, the ridges or projections on both sides and at both ends of the slider will bear against the external surfaces of the zipper profile when in the parked position and the adjoining supporting portions of the sidewall will be flexed apart by the intervening zipper profile whenever the slider is located between the park positions at opposing ends of the zipper and not yet engaged in the recesses. When the ridges or projections on one end of the slider engage the recess, the tip of each ridge or projection will be inserted into the corresponding recess to an increasing depth as the slider continues to move toward the final park position. The tapered body of the ridge or projection will slide against the lip of the recess opposite the stopping surface until the end face of the ridge or projection meets or impinges on the stopping surface, while the supporting portion of the slider sidewall flexes inwardly. As long as the minimum pull-off force is not reached, the impingement of the end faces of the ridges or projections on the stopping surfaces of the recesses in the zipper will stop the slider from further progress toward the end of the zipper. Conversely, when the slider is moved toward the middle of the zipper and away from the park position, the tapered bodies of the engaged ridges or projections will be cammed outward by the lips of the recesses, thereby flexing the supporting portions of the slider laterally outward in opposite directions. The ridges or projections bear against the exterior of the zipper as the slider moves in the opening or closing directions.

Figure 9:
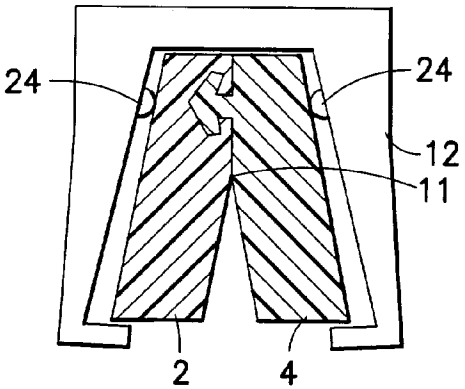
FIGS. 9 and 10 are drawings showing sectional views of the portion of reclosable package depicted in FIG. 8, the sections being respectively taken along lines 9—9 and 10—10 indicated in FIG. 8. The zipper flanges and the bag making film, which would be the same as shown in FIGS. 3 and 4, have been omitted.
Figure 10:
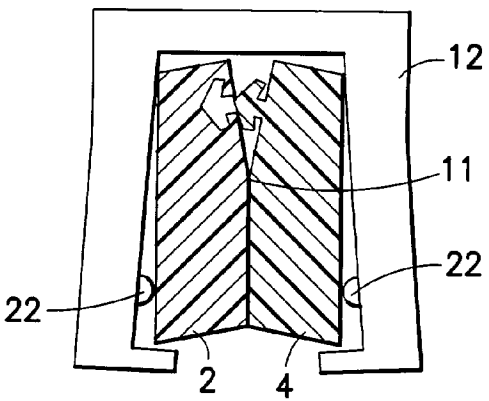
Figure 8:
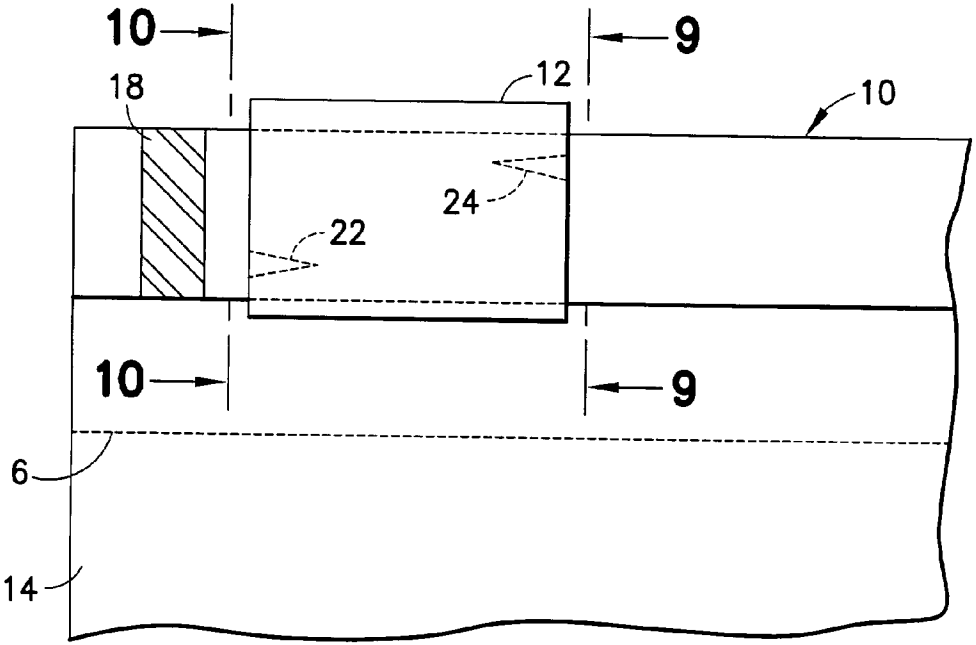
FIG. 8 is a drawing showing a fragmentary front elevational view of a reclosable package incorporating a slider-zipper assembly in accordance with another embodiment of the invention.

As best seen in FIGS. 3 and 4, in this embodiment the four ridges 20 are each located at an elevation or level that is proximal to, if not the same, as the elevation of the zipper fulcrum 11. In a second embodiment shown in FIGS. 8–10, a first pair of ridges 22 integrally formed on the interior surfaces of the sidewalls in the opening end of the slider are located at an elevation or level that is below the elevation of the zipper fulcrum 11, while a second pair of ridges 24 integrally formed on the interior surfaces of the sidewalls in the closing end of the slider are located at an elevation or level that is above the elevation of the zipper fulcrum 11. This feature takes into account the different widths of the zipper profiles measured across the gap between the pairs of opposing ridges.

Figure 11:
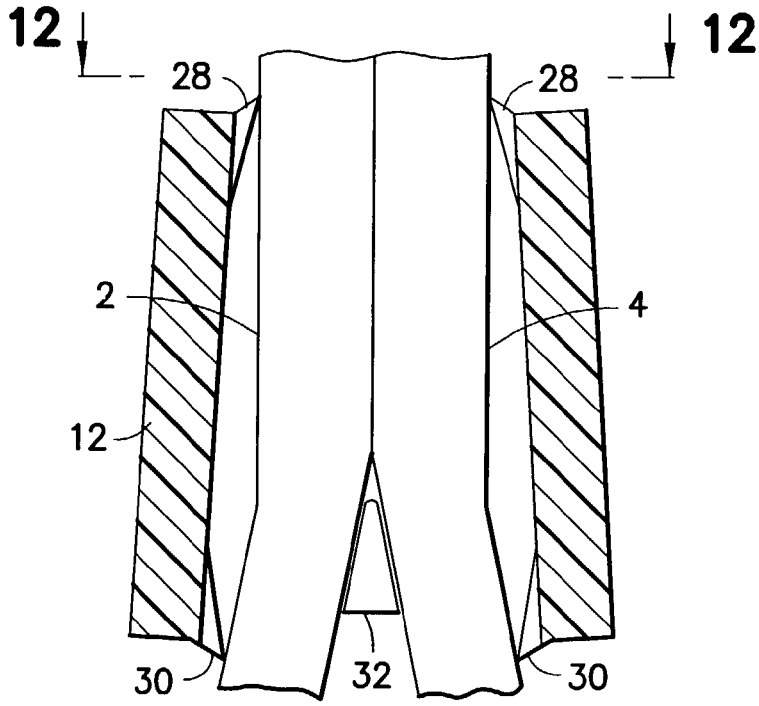
FIGS. 11 and 12 are drawings showing sectional views of a slider-zipper assembly in accordance with a further embodiment of the invention, the slider being shown in a non-parked position. The section of FIG. 11 is taken along line 11—11 indicated in FIG. 12, while the section of FIG. 12 is taken along line 12—12 indicated in FIG. 11.
Figure 12:
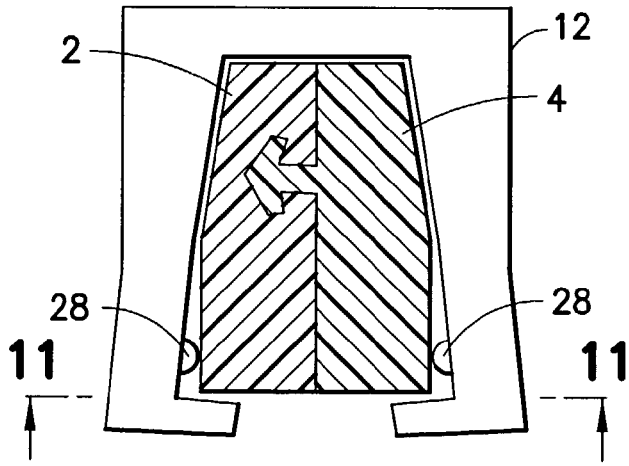
Figure 13:
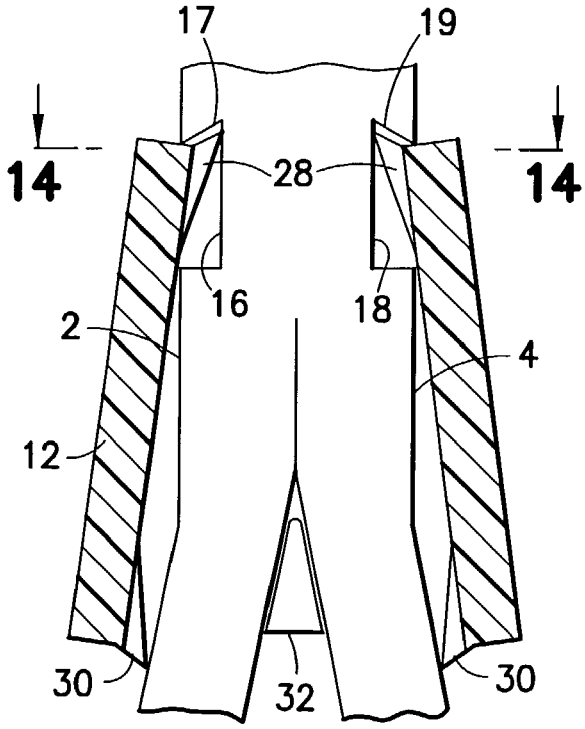
FIGS. 13 and 14 are drawings showing sectional views of the slider-zipper assembly of FIGS. 11 and 12, the slider now shown in a parked position. The section of FIG. 13 is taken along line 13—13 indicated in FIG. 14, while the section of FIG. 14 is taken along line 14—14 indicated in FIG. 13.
Figure 14:
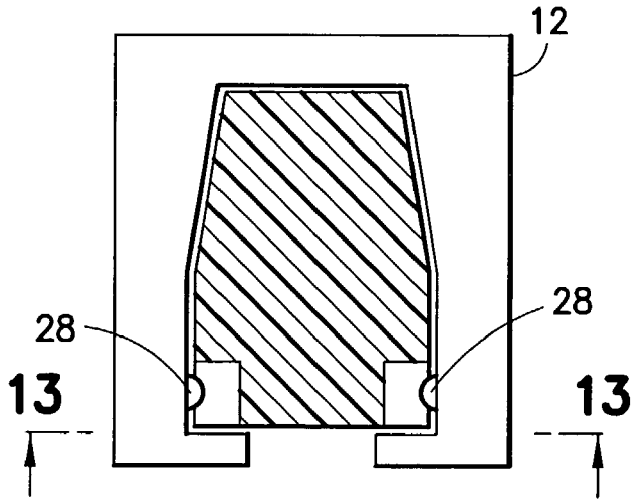

A third embodiment of the invention is depicted in FIGS. 11–14. The slider in this embodiment has a separator finger 32 that acts as a plow to wedge the zipper profiles 2 and 4 apart as the slider moves in an opening direction. FIGS. 11 and 12 show the slider located on a middle portion of the zipper, while FIGS. 13 and 14 show the slider parked in the zipper fully-open position. The slider has a first pair of projections 28 at its closing end and a second pair of projections 30 at its opening end. For the sake of illustration, the projections are shown as combining features of the ridges shown in FIGS. 5 and 7, to wit, a conical tapered body as seen in FIG. 5 and an oblique end face projecting forward of the slider end face as seen in FIG. 7. However, any of the ridge geometries depicted in FIGS. 5–7 or other suitable ridge geometries can be used. FIG. 13 also illustrates the previously described feature wherein the stopping surfaces 17 and 19 are inclined at respective acute angles relative to the planar bases of the recesses 16 and 18, each acute angle being supplementary to the oblique angle of the end faces on the respective ridges 28. The same geometry is employed at the other end of the zipper, (not shown in FIG. 13) for abutment with the end faces of respective ridges 30. The result is that, when the end faces of ridges 28 impinge on the stopping surfaces 17 and 19, the opposing surfaces at the point of impingement are substantially parallel to each other.

Figure 16:
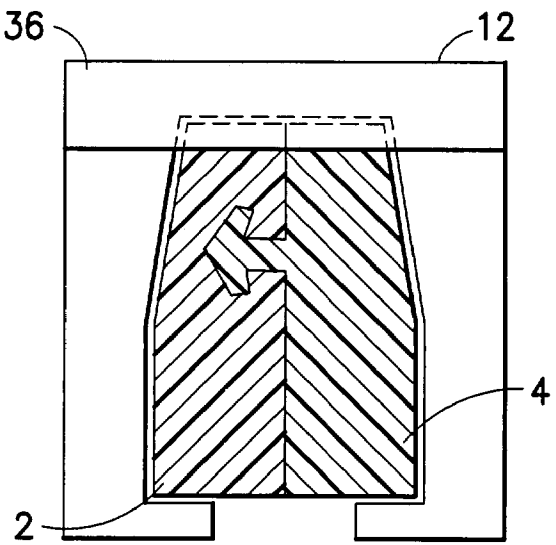
FIG. 16 is a drawing showing a sectional view of the slider-zipper assembly of FIG. 15, the section being taken along line 16—16 indicated in FIG. 15.
Figure 15:
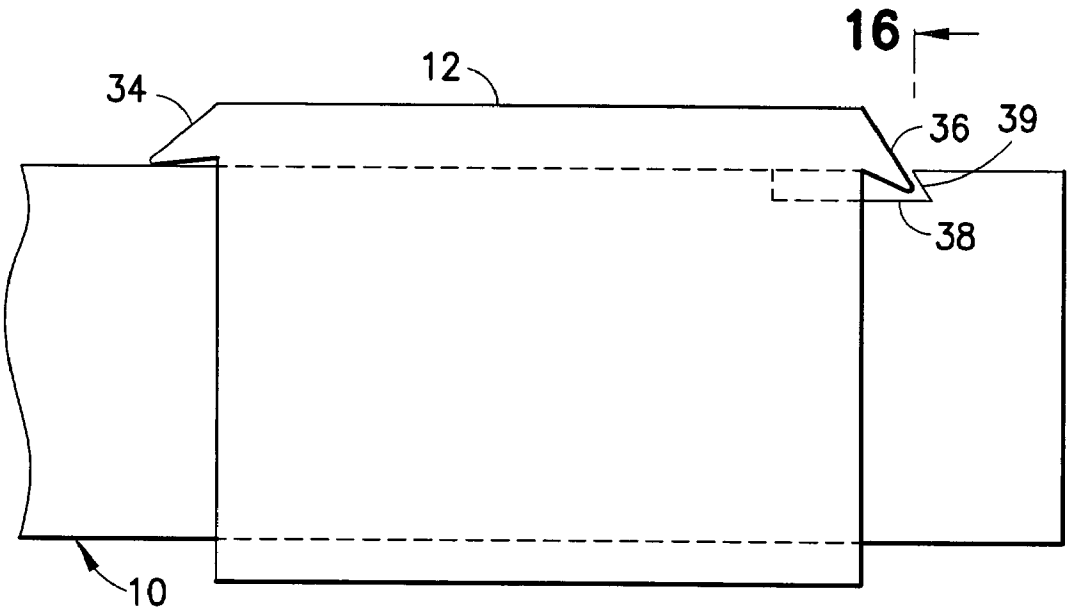
FIG. 15 is a drawing showing a fragmentary front elevational view of a slider-zipper assembly in accordance with yet another embodiment of the invention. The slider is shown in a parked position.

FIGS. 15 and 16 show another embodiment of the invention in which the slider has a pair of opposing projections 34 and 36 respectively projecting from the top portions of the end faces of the slider. In addition, the opposing ends of the zipper each have a transverse recess extending across the top of the zipper. Only one such recess 38 is shown in the fragment of the reclosable package depicted in FIG. 15. The projection 36 enters the recess 38 and impinges against the stopping surface 39. Either the projections 34 and 36 should have the ability to flex elastically or the zipper should be compressible in the elevational direction so that away from the slider park positions, the projections 34 and 36 ride along the external top surfaces of the zipper closure members, while near the slider park positions the impinging projection will change its elevational relationship to the zipper so that the tip of the projection will enter the recess, as is depicted in FIG. 15, where the tip of projection 36 has entered recess 38 and the end face of projection 36 has almost impinged on the stopping surface 39.

Although FIG. 16 shows the zipper as comprising distinct closure members 2 and 4 in the region where the recess 38 is formed, it will be appreciated that the zipper in this region may alternatively comprise a monolithic body formed by heat fusion of the ends of the closure members.

Figure 17:
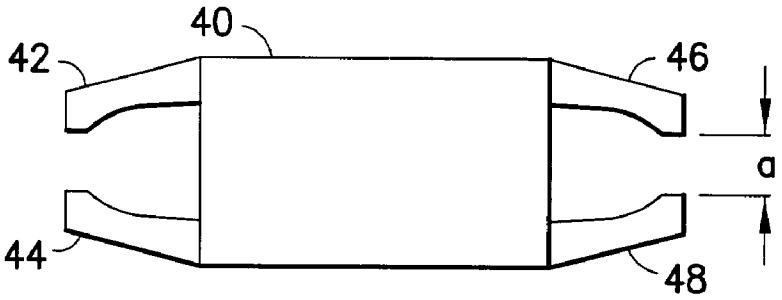
FIG. 17 is a drawing showing a top view of the slider incorporated in the assembly depicted in FIG. 18.
Figure 18:
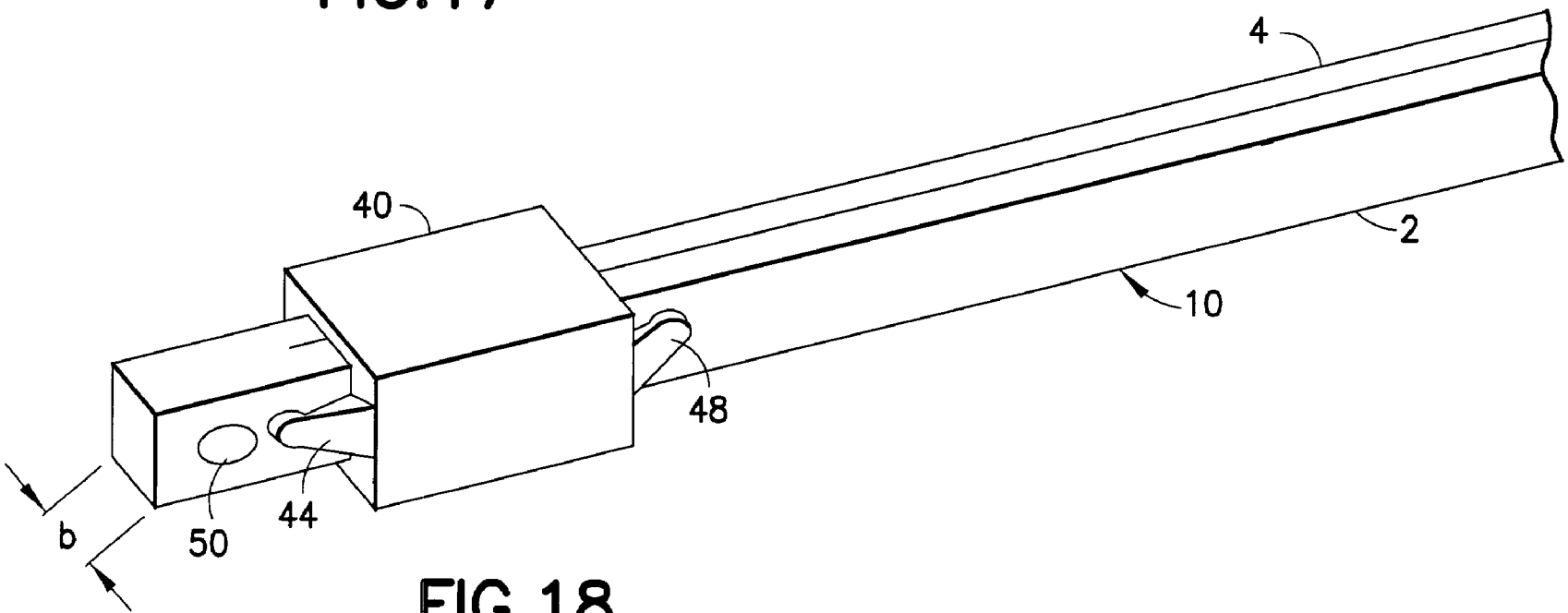
FIG. 18 is a drawing showing an isometric view of a slider-zipper assembly in accordance with a further embodiment of the invention.

Yet another embodiment of the invention is depicted in FIGS. 17 and 18. Referring to FIG. 17, a slider 40 comprises a top wall, a pair of sidewalls depending from the sides of the top wall, and two pairs of cantilevered arms, one pair of arms 42, 44 extending forward of the opening end of the slider and the other pair of arms 46, 48 extending rearward of the closing end of the slider. Each arm 42, 44, 46 and 48 has a cantilevered construction ending in a peg-shaped projection. The pegs at the ends of arms 42 and 44 confront each other, while the pegs at the ends of arms 46 and 48 also confront each other.

Each end section of the zipper 10 is provided with slider end stops on opposing sides of the zipper. Each slider end stop comprises a stopping surface that forms part of a recess or a throughhole. In FIG. 18, the structure designated 50 is one open end of a throughhole that penetrates to the other side of the zipper. Alternatively, the structure 50 can be a recess that penetrates only partially through the zipper, with another recess partially penetrating the zipper from the other side. In either case, the pegs at the ends of arms 42 and 44 on the slider are inserted into the respective openings 50 to stop the slider, as will be described in more detail below. Likewise, the pegs at the ends of arms 46 and 48 of the slider will be inserted in another pair of openings when the slider travels to the other park position at the opposing end of the zipper (not shown in FIG. 18).

The arms 42, 44, 46 and 48 are designed to be elastically flexible in a direction transverse to the longitudinal axis of the zipper. In other words, the arms 42 and 44 flex so that the pegs at their ends move toward or away from each other. The same is true of arms 46 and 48. As seen in FIG. 17, the opposing end faces of the pegs at the ends of each pair of arms are separated by a gap having a length a, while the width of the zipper equals b, where $a<b$. In this case, the elasticity of the arm material allows the pegs to slide over the outside of the zipper (the arms flex outward), but then forces the pegs into the holes at either end of the zipper when the slider approaches one of the park positions.

As seen in FIG. 17, the arms may be provided with curved interior surfaces that allow the arms to exit the holes 50 without the pegs latching or catching on the rims of the holes. The rims of the holes that contact the curved interior surfaces of the arms will cam the flexible arms outward as the slider departs from the park position. Alternatively, a portion of the periphery of each opening may have a ramp along which the incoming or outgoing peg can slide smoothly without getting caught.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

The invention claimed is:

1. A reclosable package comprising a receptacle having a mouth, a zipper joined to said receptacle, and a slider mounted to said zipper, wherein said zipper comprises first and second interlockable profiled closure members joined along respective sections proximal to respective ends of said zipper and joined to said receptacle in a manner such that said mouth is closed when said profiled closure members are interlocked with each other and said mouth is open when said profiled closure members are disengaged from each other, a first recess proximal to one end of said zipper and defined in part by a first stopping surface generally facing toward the other end of said zipper, and a second recess proximal to said other end of said zipper and defined in part by a second stopping surface generally facing toward said one end of said zipper, and wherein said slider is movable between first and second slider park positions for engaging or disengaging confronting portions of said first and second closure members and comprises a first projection arranged to impinge on said first stopping surface and a second projection arranged to impinge on said second stopping surface, said first stopping surface posing an obstacle to further travel of said slider in a first direction during impingement of said first projection, said second stopping surface posing an obstacle to further travel of said slider in a second direction during impingement of said second projection, said second direction being generally opposite to said first direction, and said first and second projections being disposed outside said zipper when said slider is located in the middle of said zipper, wherein said zipper has a fulcrum, and said first and second projections are located at respective elevations that are proximal to an elevation of said fulcrum.

2. The package as recited in claim 1, wherein said zipper further comprises a second recess proximal to said one end of said zipper and defined in part by a second stopping surface generally facing toward said other end of said zipper; and wherein said slider further comprises a second projection arranged to impinge on said second stopping surface, said second stopping surface also posing an obstacle to further travel of said slider in said first direction during impingement of said second projection.

3. The package as recited in claim 2, wherein said first and second projections are located on opposite sides of the same end of said slider.

4. The package as recited in claim 1, wherein said first projection comprises a contact surface that impinges on said first stopping surface, said contact surface and said first stopping surface being generally parallel to each other during impingement.

5. The package as recited in claim 4, wherein said contact surface of said first projection and said first stopping surface are substantially perpendicular to said first direction.

6. A reclosable package comprising a receptacle having a mouth, a zipper joined to said receptacle, and a slider mounted to said zipper, wherein said zipper comprises first and second interlockable profiled closure members joined along respective sections proximal to respective ends of said zipper and joined to said receptacle in a manner such that said mouth is closed when said profiled closure members are interlocked with each other and said mouth is open when said profiled closure members are disengaged from each other, a first recess proximal to one end of said zipper and defined in part by a first stopping surface generally facing toward the other end of said zipper, and a second recess proximal to said other end of said zipper and defined in part by a second stopping surface generally facing toward said one end of said zipper, and wherein said slider is movable between first and second slider park positions for engaging or disengaging confronting portions of said first and second closure members and comprises a first projection arranged to impinge on said first stopping surface and a second projection arranged to impinge on said second stopping surface, said first stopping surface posing an obstacle to further travel of said slider in a first direction during impingement of said first projection, said second stopping surface posing an obstacle to further travel of said slider in a second direction during impingement of said second projection, said second direction being generally opposite to said first direction, and said first and second projections being disposed outside said zipper when said slider is located in the middle of said zipper, wherein said zipper has a fulcrum, and said first projection is located at a first elevation that is higher than an elevation of said fulcrum and said second projection is located at a second elevation that is lower than said elevation of said fulcrum.

7. A reclosable package comprising a receptacle having a mouth, a zipper joined to said receptacle, and a slider mounted to said zipper, wherein said zipper comprises first and second interlockable profiled closure members joined along respective sections proximal to respective ends of said zipper and joined to said receptacle in a manner such that said mouth is closed when said profiled closure members are interlocked with each other and said mouth is open when said profiled closure members are disengaged from each other, a first recess proximal to one end of said zipper and defined in part by a first stopping surface generally facing toward the other end of said zipper, and a second recess proximal to said other end of said zipper and defined in part by a second stopping surface generally facing toward said one end of said zipper, and wherein said slider is movable between first and second slider park positions for engaging or disengaging confronting portions of said first and second closure members and comprises a first projection arranged to impinge on said first stopping surface and a second projection arranged to impinge on said second stopping surface, said first stopping surface posing an obstacle to further travel of said slider in a first direction during impingement of said first projection, said second stopping surface posing an obstacle to further travel of said slider in a second direction during impingement of said second projection, said second direction being generally opposite to said first direction, and said first and second projections being disposed outside said zipper when said slider is located in the middle of said zipper, wherein said first and second projections are located at opposite ends of said slider.

8. A reclosable package comprising a receptacle having a mouth, a zipper joined to said receptacle, and a slider mounted to said zipper, wherein said zipper comprises first and second interlockable profiled closure members joined along respective sections proximal to respective ends of said zipper and joined to said receptacle in a manner such that said mouth is closed when said profiled closure members are interlocked with each other and said mouth is open when said profiled closure members are disengaged from each other, and a first recess proximal to one end of said zipper and defined in part by a first stopping surface generally facing toward the other end of said zipper, and wherein said slider is movable between first and second slider park positions for engaging or disengaging confronting portions of said first and second closure members and comprises a first projection arranged to impinge on said first stopping surface, said first stopping surface posing an obstacle to further travel of said slider in a first direction during impingement of said first projection, and said first projection being disposed outside said zipper when said slider is located in the middle of said zipper, wherein said first projection comprises a contact surface that impinges on said first stopping surface, said contact surface and said first stopping surface being generally parallel to each other during impingement, said contact surface of said first projection and said first stopping surface being oblique to said first direction, said stopping surface deflecting said first projection toward said zipper.

9. A reclosable package comprising a receptacle having a mouth, a zipper joined to said receptacle, and a slider mounted to said zipper, wherein said zipper comprises first and second interlockable profiled closure members joined along respective sections proximal to respective ends of said zipper and joined to said receptacle in a manner such that said mouth is closed when said profiled closure members are interlocked with each other and said mouth is open when said profiled closure members are disengaged from each other, and a first recess proximal to one end of said zipper and defined in part by a first stopping surface generally facing toward the other end of said zipper, and wherein said slider is movable between first and second slider park positions for engaging or disengaging confronting portions of said first and second closure members and comprises a first projection arranged to impinge on said first stopping surface, said first stopping surface posing an obstacle to further travel of said slider in a first direction during impingement of said first projection, and said first projection being disposed outside said zipper when said slider is located in the middle of said zipper, wherein said slider comprises first and second sidewalls separated by a gap penetrated by said zipper, and a top wall connected on one side to said first sidewall and on the other side to said second sidewall, said first projection being integrally formed with said top wall and extending forward of said top wall.

10. A reclosable package comprising a receptacle having a mouth, a zipper joined to said receptacle, and a slider mounted to said zipper, wherein said zipper comprises first and second interlockable profiled closure members joined along respective sections proximal to respective ends of said zipper and joined to said receptacle in a manner such that said mouth is closed when said profiled closure members are interlocked with each other and said mouth is open when said profiled closure members are disengaged from each other, and a first recess proximal to one end of said zipper and defined in part by a first stopping surface generally facing toward the other end of said zipper, and wherein said slider is movable between first and second slider park positions for engaging or disengaging confronting portions of said first and second closure members and comprises a first projection arranged to impinge on said first stopping surface, said first stopping surface posing an obstacle to further travel of said slider in a first direction during impingement of said first projection, and said first projection being disposed outside said zipper when said slider is located in the middle of said zipper, wherein said slider comprises first and second sidewalls separated by a gap penetrated by said zipper, and an arm having one end connected to said first side wall and extending forward of said first side wall, said first projection being integrally formed on the other end of said arm.

11. A reclosable package comprising a receptacle having a mouth, a zipper joined to said receptacle, and a slider mounted to said zipper, wherein said zipper comprises first and second interlockable profiled closure members joined along respective sections proximal to respective ends of said zipper and joined to said receptacle in a manner such that said mouth is closed when said profiled closure members are interlocked with each other and said mouth is open when said profiled closure members are disengaged from each other, and a first recess proximal to one end of said zipper and defined in part by a first stopping surface generally facing toward the other end of said zipper, and wherein said slider is movable between first and second slider park positions for engaging or disengaging confronting portions of said first and second closure members and comprises a first projection arranged to impinge on said first stopping surface, said first stopping surface posing an obstacle to further travel of said slider in a first direction during impingement of said first projection, and said first projection being disposed outside said zipper when said slider is located in the middle of said zipper, wherein said first projection comprises a tapered ridge of curving form.

12. A reclosable package comprising a receptacle having a mouth, a zipper joined to said receptacle, and a slider mounted to said zipper, wherein said zipper comprises first and second interlockable profiled closure members joined along respective sections proximal to respective ends of said zipper and joined to said receptacle in a manner such that said mouth is closed when said profiled closure members are interlocked with each other and said mouth is open when said profiled closure members are disengaged from each other, a first recess proximal to one end of said zipper and defined in part by a first stopping surface generally facing toward the other end of said zipper, and a second recess proximal to said other end of said zipper and defined in part by a second stopping surface generally facing toward said one end of said zipper, and wherein said slider is movable between first and second slider park positions for engaging or disengaging confronting portions of said first and second closure members, a first portion of said slider being in contact with said first stopping surface in said first slider park position and a second portion of said slider being in contact with said second stopping surface in said second slider park position, said first and second portions of said slider being disposed outside said zipper when said slider is located in the middle of said zipper, wherein said first recess is formed in adjoining first top portions of said first and second profiled closure members, and said second recess is formed in adjoining second top portions of said first and second profiled closure members, said first and second recesses extending transverse to a longitudinal axis of said zipper.

13. A reclosable package comprising a receptacle having a mouth, a zipper joined to said receptacle, and a slider mounted to said zipper, wherein said zipper comprises first and second interlockable profiled closure members joined along respective sections proximal to respective ends of said zipper and joined to said receptacle in a manner such that said mouth is closed when said profiled closure members are interlocked with each other and said mouth is open when said profiled closure members are disengaged from each other, a first recess proximal to one end of said zipper and defined in part by a first stopping surface generally facing toward the other end of said zipper, a second recess proximal to said other end of said zipper and defined in part by a second stopping surface generally facing toward said one end of said zipper, a third recess proximal to said one end of said zipper and defined in part by a third stopping surface generally facing toward said other end of said zipper, and a fourth recess proximal to said other end of said zipper and defined in part by a fourth stopping surface generally facing toward said one end of said zipper, and wherein said slider is movable between first and second slider park positions for engaging or disengaging confronting portions of said first and second closure members, a first portion of said slider being in contact with said first stopping surface in said first slider park position, a second portion of said slider being in contact with said second stopping surface in said second slider park position, a third portion of said slider is in contact with said third stopping surface in said first slider park position and a fourth portion of said slider is in contact with said fourth stopping surface in said second slider park position, said first and second portions of said slider being disposed outside said zipper when said slider is located in the middle of said zipper, said first and third recesses being located on opposing sides of said zipper, and said second and fourth recesses being located on opposing sides of said zipper, wherein said slider comprises:

first and second sidewalls separated by a gap penetrated by said zipper;

a first cantilevered arm having one end connected to said first side wall and extending forward of said first side wall, and having a first free end comprising a first end face, said first portion of said slider comprising at least a portion of said first end face;

a second cantilevered arm having one end connected to said first side wall and extending rearward of said first side wall, and having a second free end comprising a second end face, said second portion of said slider comprising at least a portion of said second end face;

a third cantilevered arm having one end connected to said second side wall and extending forward of said second side wall, and having a third free end comprising a third end face, said third portion of said slider comprising at least a portion of said third end face; and a fourth cantilevered arm having one end connected to said second side wall and extending rearward of said second side wall, and having a fourth free end comprising a fourth end face, said fourth portion of said slider comprising at least a portion of said fourth end face, wherein said first and third arms are designed to flex away from each other when an unrecessed portion of said zipper is disposed therebetween and to press toward each other and into said first and third recesses respectively when said first and third free ends respectively overlie said first and third recesses, and said second and fourth arms are designed to flex away from each other when an unrecessed portion of said zipper is disposed therebetween and to relax toward each other and into said second and fourth recesses respectively when said second and fourth free ends respectively overlie said second and fourth recesses.

14. A reclosable package comprising a receptacle having a mouth, a zipper joined to said receptacle, and a slider mounted to said zipper, wherein said zipper comprises first and second interlockable profiled closure members joined along respective sections proximal to respective ends of said zipper and joined to said receptacle in a manner such that said mouth is closed when said profiled closure members are interlocked with each other and said mouth is open when said profiled closure members are disengaged from each other, a first throughhole proximal to one end of said zipper and a second throughhole proximal to said other end of said zipper, each of said first and second throughholes passing through said first and second profiled closure members, and wherein said slider is movable between first and second slider park positions for engaging or disengaging confronting portions of said first and second closure members, a first portion of said slider being inserted in one end of said first throughhole in said first slider park position and a second portion of said slider being inserted in one end of said second throughhole in said second slider park position.

15. The package as recited in claim 14, wherein a third portion of said slider is inserted in the other end of said first throughhole in said first slider park position and a fourth portion of said slider is inserted in the other end of said second throughhole in said second slider park position.

16. The package as recited in claim 15, wherein said slider comprises:

first and second sidewalls separated by a gap penetrated by said zipper;

a first cantilevered arm having one end connected to said first side wall and extending forward of said first side wall, and having a first free end comprising a first end face, said first portion of said slider comprising at least a portion of said first end face;

a second cantilevered arm having one end connected to said first side wall and extending rearward of said first side wall, and having a second free end comprising a second end face, said second portion of said slider comprising at least a portion of said second end face;

a third cantilevered arm having one end connected to said second side wall and extending forward of said second side wall, and having a third free end comprising a third end face, said third portion of said slider comprising at least a portion of said third end face; and a fourth cantilevered arm having one end connected to said second side wall and extending rearward of said second side wall, and having a fourth free end comprising a fourth end face, said fourth portion of said slider comprising at least a portion of said fourth end face, wherein said first and third arms are designed to flex away from each other when central portions of said first and second profiled closure members are disposed therebetween and to press toward each other and into said respective ends of said first throughhole when said first and third free ends of said first and third arms respectively overlie said ends of said first throughhole, and said second and fourth arms are designed to flex away from each other when central portions of said first and second profiled closure members are disposed therebetween and to press toward each other and into said respective ends of said second throughhole when said second and fourth free ends of said second and fourth arms respectively overlie said ends of said second throughhole.

17. The package as recited in claim 15, wherein said slider comprises:

first and second sidewalls separated by a gap penetrated by said zipper;

a first projection integrally formed with said first side wall and projecting into said gap, said first projection being disposed between said first side wall and said zipper, said first portion of said slider comprising at least a portion of said first projection;

a second projection integrally formed with said first side wall and projecting into said gap, said second projection being disposed between said first side wall and said zipper, said second portion of said slider comprising at least a portion of said second projection;

a third projection integrally formed with said second side wall and projecting into said gap, said third projection being disposed between said second side wall and said zipper, said third portion of said slider comprising at least a portion of said third projection; and a fourth projection integrally formed with said second side wall and projecting into said gap, said fourth projection being disposed between said second side wall and said zipper, said fourth portion of said slider comprising at least a portion of said fourth projection.

* * * * *